US009741518B2

(12) United States Patent
Choi

(10) Patent No.: US 9,741,518 B2
(45) Date of Patent: Aug. 22, 2017

(54) LATCH RELAY

(71) Applicant: LSIS CO., LTD., Anyang-si, Gyeonggi-do (KR)

(72) Inventor: Yeonsoon Choi, Anyang-si (KR)

(73) Assignee: LSIS CO., LTD., Anyang-si (KR)

( * ) Notice: Subject to any disclaimer, the term of this patent is extended or adjusted under 35 U.S.C. 154(b) by 0 days.

(21) Appl. No.: 15/195,614

(22) Filed: Jun. 28, 2016

(65) Prior Publication Data

US 2017/0018385 A1 Jan. 19, 2017

(30) Foreign Application Priority Data

Jul. 15, 2015 (KR) ..... 10-2015-0100625

(51) Int. Cl.
*H01H 9/00* (2006.01)
*H01H 50/36* (2006.01)
*H01H 50/24* (2006.01)

(52) U.S. Cl.
CPC ..... *H01H 50/36* (2013.01); *H01H 50/24* (2013.01); *H01H 2235/01* (2013.01)

(58) Field of Classification Search
CPC ..... H01F 7/121; H01F 7/1646; F01L 1/14; F01L 1/34; F01L 9/04; F01L 25/08
USPC ..... 335/179
See application file for complete search history.

(56) References Cited

U.S. PATENT DOCUMENTS 3,993,971 A * 11/1976 Ono ..... H01H 50/58 335/125
5,272,458 A * 12/1993 Hoffman ..... H01H 51/2209 335/179
5,910,759 A * 6/1999 Passow ..... H01H 51/2227 335/113

(Continued)

FOREIGN PATENT DOCUMENTS

JP 2006040661 2/2006
JP 2006196357 7/2006

(Continued)

OTHER PUBLICATIONS

Korean Intellectual Property Office Application No. 10-2015-0100625, Search Report dated Oct. 8, 2015, 5 pages.

*Primary Examiner* — Shawki S Ismail
*Assistant Examiner* — Lisa Homza
(74) *Attorney, Agent, or Firm* — Lee, Hong, Degerman, Kang & Waimey

(57) ABSTRACT

A latch relay includes a frame, a bobbin installed in the frame and having a coil wound therearound, first and second yokes provided as magnetic bodies, a rotary mover rotating in a clockwise direction or in a counterclockwise direction between head portions of the first and second yokes, first and second fixed contactors installed to be spaced apart from one another and parallel to each other within the frame, a movable contactor having one end connected to the second fixed contactor, a transmission lever having one end coupled to one side of the rotary mover to make a vertical movement, a support member fixedly installed on one side of the (Continued)

transmission lever, and an elastic member providing contact force such that the movable contactor is brought into contact with the first fixed contactor or separated from the first fixed contactor, while moving according to a movement of the transmission lever.

5 Claims, 6 Drawing Sheets

(56) References Cited

U.S. PATENT DOCUMENTS 5,959,518 A * 9/1999 Passow ..... H01H 71/58 335/113
5,994,987 A * 11/1999 Passow ..... H01H 71/323 335/124
6,020,801 A * 2/2000 Passow ..... H01H 51/2227 335/113
6,426,689 B1 * 7/2002 Nakagawa ..... H01H 51/2272 335/78
6,788,176 B2 * 9/2004 Schmelz ..... H01H 51/2227 335/124
6,949,997 B2 * 9/2005 Bergh ..... H01H 50/326 335/78
7,049,911 B2 * 5/2006 Germain ..... H01H 83/04 335/18
7,161,104 B2 * 1/2007 Bergh ..... H01H 51/2227 200/292
7,164,563 B2 * 1/2007 Chan ..... H02H 3/338 361/42
7,495,535 B2 * 2/2009 Mikl ..... H01H 50/36 335/179
7,659,800 B2 * 2/2010 Gruner ..... H01H 1/26 335/185
7,889,032 B2 * 2/2011 Parker ..... H01H 51/2227 335/128
8,203,403 B2 * 6/2012 Moeller ..... H01H 50/642 335/129
8,222,981 B1 * 7/2012 Zarbock ..... H01H 51/2272 335/107
8,222,982 B2 * 7/2012 Sullivan ..... H01H 71/2472 335/166
8,330,564 B2 * 12/2012 Miller ..... H01H 1/54 335/128
8,514,040 B2 * 8/2013 Gruner ..... H01H 1/54 335/125
8,564,386 B2 * 10/2013 Moeller ..... H01H 50/642 335/132
8,823,473 B2 * 9/2014 Fujita ..... H01H 50/24 335/128
8,830,017 B2 * 9/2014 Yang ..... H01H 50/18 335/78
9,159,515 B2 * 10/2015 Iwamoto ..... H01H 51/22
9,305,718 B2 * 4/2016 Iwamoto ..... H01H 3/001
2003/0112103 A1 * 6/2003 Schmelz ..... H01H 1/26 335/128
2009/0033447 A1 * 2/2009 Gruner ..... H01H 51/2281 335/189

FOREIGN PATENT DOCUMENTS

| | | |
|---|---|---|
| JP | 2006196362 | 7/2006 |
| JP | 2011014399 | 1/2011 |
| KR | 1992005204 | 3/1992 |
| KR | 200292167 | 10/2002 |
| KR | 101006320 | 1/2011 |
| KR | 101247121 | 4/2013 |

* cited by examiner

LATCH RELAY

CROSS-REFERENCE TO RELATED APPLICATION

Pursuant to 35 U.S.C. §119(a), this application claims the benefit of earlier filing date and right of priority to Korean Patent Application No. 10-2015-0100625, filed on Jul. 15, 2015, the contents of which are all hereby incorporated by reference herein in its entirety.

BACKGROUND OF THE INVENTION

1. Field of the Invention

The present disclosure relates to a latch relay and, more particularly, to a latch relay having consistency of performance by reducing a load variation applied to a movable contactor and maintaining a uniform operational distance of the movable contactor.

2. Background of the Invention

In general, a relay or an electromagnetic contactor is a type of an electric circuit switching device transmitting mechanical driving signal and a current signal using a principle of an electromagnet, which is installed in various industrial facilities, machines, and vehicles.

Among relays, in particular, a latch relay, also called a bi-stable relay, features that a switched state is maintained even energy is not supplied after an operation. The latch relay has a structure generally operated by a permanent magnet and a solenoid actuator.

A latch relay (Korean Patent Laid-Open Application No. 10-2014-0129420) devised and filed by the inventor of the present application is illustrated in FIG. 1.

The related art discloses a latch relay including a frame 110; a bobbin 120 installed in the frame 110 and having a coil 121 wound therearound; first and second yokes 130 and 135 coupled to both sides of the bobbin 120 and provided as magnetic bodies; a rotary mover 140 formed of a magnetic body and rotating in a clockwise direction or in a counterclockwise direction between head portions 132 and 137 of the first and second yokes 130 and 135; a transmission lever 150 having one end coupled to one side of the rotary mover 140 to make a vertical movement; and leaf spring 175 moved by the other end of the transmission lever 150 to cause the movable contactor 170 to be brought into contact with the first fixed contactor 160 or separate the movable contactor 170 from the fixed contactor 160, wherein a horizontal long hole 151 is formed in the transmission lever 150 and a shaft member 149 slidably coupled to the horizontal long hole 151 is provided on one side of the rotary mover 140.

In the related art, the movable contactor 170 is configured to be brought into contact with the fixed contactor 160 by the leaf spring 175. That is, the transmission lever 150 pushes up the leaf spring 175 having elasticity, generating a contact force, and here, a movable contact 172 is brought into contact with a fixed contact 162 using the generated contact force, thus exhibiting conduction performance. Here, the contact force greatly affects the conduction performance and is closely related to contact resistance (electromagnetic repulsion force).

However, in the related art latch relay, as the leaf spring is used for a long period of time, fatigue failure may occur in a material thereof to reduce contact force due to plastic deformation. Thus, an operational distance of the movable contactor may be reduced to degrade conduction performance or cause defective conduction. Also, variations occur in operational loads of the leaf spring during ON/OFF operations in terms of material characteristics, causing a problem in that operational characteristics thereof are different in the ON/OFF operations (i.e., when the latch relay is turned on or off). In addition, the leaf spring has a large load error by products and load variations regarding deformation, resulting in a degradation of consistency by products.

SUMMARY OF THE INVENTION

Therefore, an aspect of the detailed description is to provide a latch relay capable of maintaining consistency of conduction performance and cutoff (breaking) performance by reducing a load variation applied to a movable contactor and maintaining a uniform operational distance of the movable contactor.

To achieve these and other advantages and in accordance with the purpose of this specification, as embodied and broadly described herein, a latch relay includes: a frame; a bobbin installed in the frame and having a coil wound therearound; first and second yokes coupled to both sides of the bobbin and provided as magnetic bodies; a rotary mover formed of a magnetic body and rotating in a clockwise direction or in a counterclockwise direction between head portions of the first and second yokes; first and second fixed contactors installed to be spaced apart from one another and parallel to each other within the frame; a movable contactor having one end connected to the second fixed contactor; a transmission lever having one end coupled to one side of the rotary mover to make a vertical movement; a support member fixedly installed on one side of the transmission lever; and an elastic member provided between the support member and the movable contactor and providing contact force such that the movable contactor is brought into contact with the first fixed contactor or separated from the first fixed contactor, while moving according to a movement of the transmission lever.

The elastic member may be configured as a compressive coil spring.

The support member may be integrally formed with the transmission lever.

A movable contact provided in the movable contactor and a fixed contact provided in the fixed contactor may be disposed to be aligned with the elastic member in the centers thereof.

A lower protrusion portion for fixing the elastic member may be formed on an upper portion of the support member, and an upper protrusion portion for fixing the elastic member may be formed on a lower portion of the movable contactor.

In the latch relay according to an embodiment of the present disclosure, since the support member and the elastic member are provided between the movable contactor and the transmission lever so the movable contact may be brought into contact with the fixed contact or separated therefrom in a straight line, while receiving a vertical force, stable conduction and breaking performance may be exhibited. In addition, since the elastic member is configured as a coil spring, predetermined operation performance is maintained when a current flows or cut off, durability may be increased, and variations of products in terms of deformation may be reduced.

Further scope of applicability of the present application will become more apparent from the detailed description given hereinafter. However, it should be understood that the detailed description and specific examples, while indicating preferred embodiments of the invention, are given by way of illustration only, since various changes and modifications within the scope of the invention will become apparent to those skilled in the art from the detailed description.

BRIEF DESCRIPTION OF THE DRAWINGS

The accompanying drawings, which are included to provide a further understanding of the invention and are incorporated in and constitute a part of this specification, illustrate exemplary embodiments and together with the description serve to explain the principles of the invention.

In the drawings:

FIGS. 5A and 5B are views illustrating an operation of a latch relay according to an embodiment of the present disclosure, wherein FIG. 5A illustrates a conduction state (ON state) and FIG. 5B illustrates a cutoff state (OFF state).

DETAILED DESCRIPTION OF THE INVENTION

Hereinafter, exemplary embodiments of the present disclosure will be described in detail with reference to the accompanying drawings so that a person skilled in the art to which the present invention pertains to easily implement the invention, but the present invention is not limited thereto.

Figure 1:
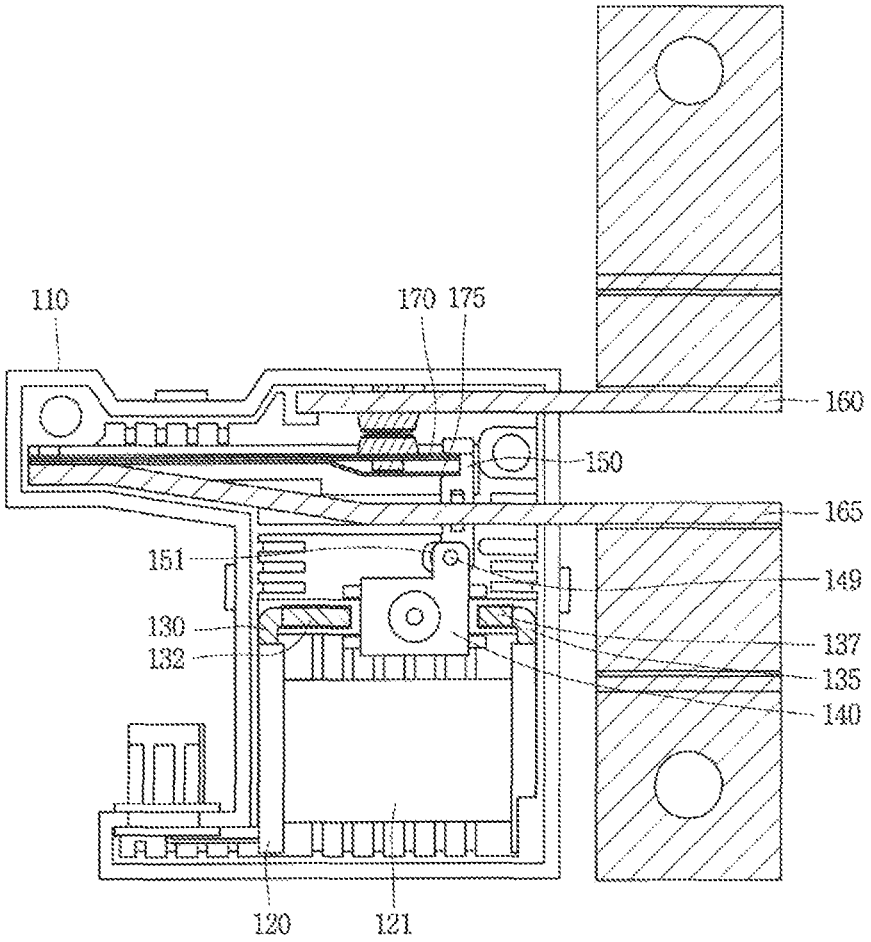
FIG. 1 Prior Art
FIG. 1 is a view illustrating an internal structure of a latch relay according to the related art.
Figure 2:
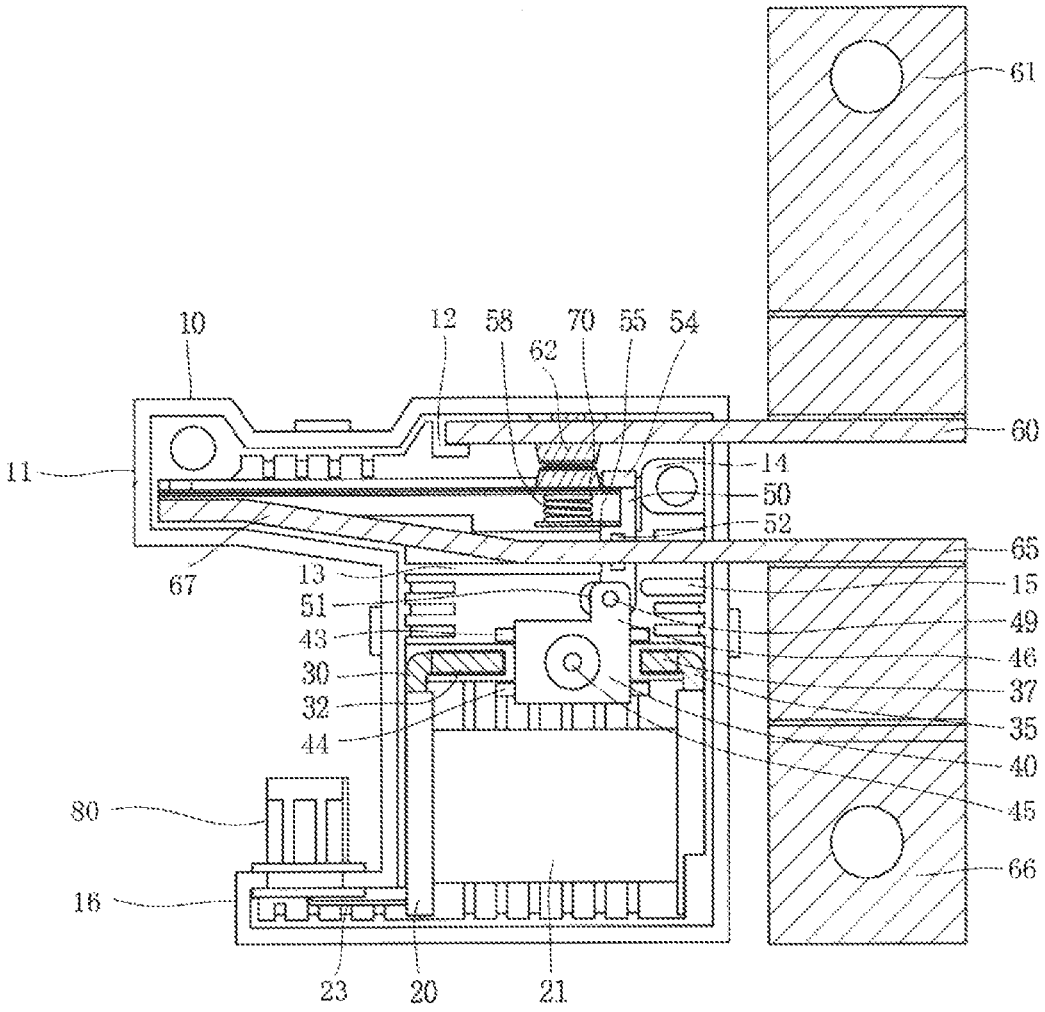
FIG. 2 is a view illustrating an internal structure of a latch relay according to an embodiment of the present disclosure.
Figure 3:
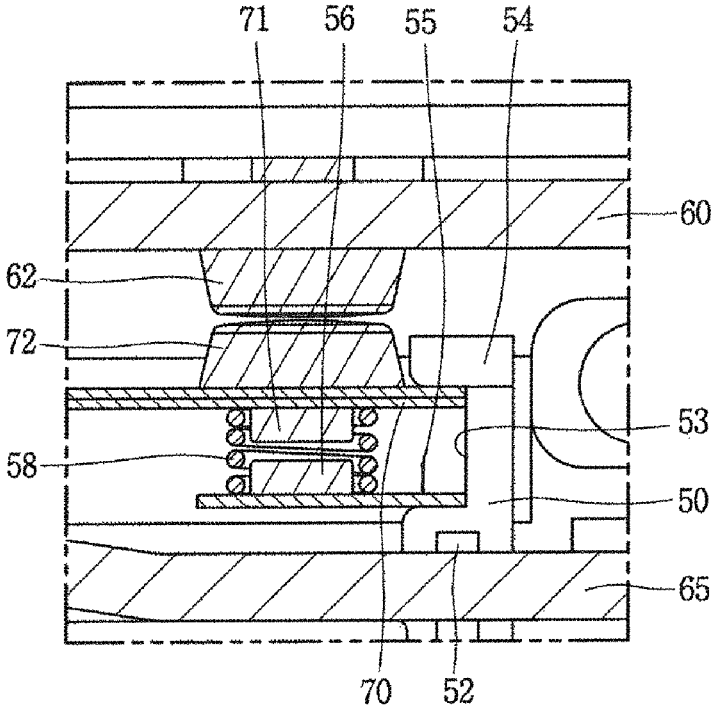
FIG. 3 is a partial detailed view of a contact part of FIG. 2.

FIG. 2 is a view illustrating an internal structure of a latch relay according to an embodiment of the present disclosure. FIG. 3 is a partial detailed view of a contact part of FIG. 2. A latch relay according to an embodiment of the present disclosure will be described in detail with reference to the accompanying drawings.

The latch relay according to an embodiment of the present disclosure includes a frame 10; a bobbin 20 installed in the frame 10 and having a coil 21 wound therearound; first and second yokes 30 and 35 coupled to both sides of the bobbin 20 and provided as magnetic bodies; a rotary mover 40 formed of a magnetic body and rotating in a clockwise direction or in a counterclockwise direction between head portions 32 and 37 of the first and second yokes 30 and 35; first and second fixed contactors 60 and 65 installed to be spaced apart from one another and parallel to each other within the frame 10; a movable contactor 70 having one end connected to the second fixed contactor 65; a transmission lever 50 having one end coupled to one side of the rotary mover 40 to make a vertical movement; a support member 55 fixedly installed on one side of the transmission lever 50; and an elastic member 58 provided between the support member 55 and the movable contactor 70 and providing contact force such that the movable contactor 70 is brought into contact with the first fixed contactor 60 or separated from the first fixed contactor 60, while moving according to a movement of the transmission lever 50.

The frame 10 may have a substantially box shape. The frame 10 may be formed of a synthetic resin having insulating properties. A cover (not shown) may be coupled to the frame 10 to protect internal components.

First and second fixing parts 11 and 16 may be formed to protrude from upper and lower end portions of one side of the frame 10. The first and second fixed contacts 60 and 65 and the movable contactor 70 may be installed in the first fixing part 11. A terminal block 80 may be installed in the second fixing part 16.

First, second, and third support portions 13, 14, and 15 may be formed to protrude to an inner side of the frame 10. The first support portion 13 supports the second fixed contactor 65 and the transmission lever 50. The second and third support portions 14 and 15 support the transmission lever 50 on the opposite side of the first support portion 13.

The coil 21 is wound around the bobbin 20 and the bobbin 20 is installed in a lower portion of the frame 10. A terminal pin 23 supplying a current to the coil 21 is provided on one side of the bobbin 20.

The first and second yokes 30 and 35 may be magnetic bodies and may be formed to have a substantially asymmetrical '⊂' shape. The first and second yokes 30 and 35 are symmetrically installed on each side of the bobbin 20. Leg portions (not shown) of the first and second yokes 30 and 35 may be inserted into the bobbin 20 and fixedly installed therein. The head portions 32 and 37 of the first and second yokes 30 and 35 are exposed from upper portions of the bobbin 20. The first and second yokes 30 and 35 assume magnetic poles in the mutually opposite directions according to a direction of a current flowing in the coil 21.

The rotary mover 40 has an 'H' shape overall. A permanent magnet (not shown) is installed within the rotary mover 40. First and second magnet plates 43 and 44 are coupled to upper and lower surfaces of the permanent magnet in a penetrating manner. The first and second magnet plates 43 and 44 are partially exposed from left and right sides of a body part 41. The exposed portions of the first and second magnet plates 43 and 44 assume N and S poles, respectively, by the permanent magnet. A rotational shaft 45 is protrusively formed at the center of the rotary mover 40 in a forward/backward direction. The rotary mover 40 may rotate in a clockwise or counterclockwise direction, centered on the rotational shaft 45.

An installation portion 46 allowing for installation of a shaft member 49 is protrusively formed in one upper portion of the rotary mover 40. An installation recess for inserting the shaft member 49 is formed in the installation portion 46. Here, the shaft member 49 may be configured as a pin or a rivet.

The transmission lever 50 has a substantially square bar shape. A horizontal long hole 51 is formed below the transmission lever 50. The shaft member 49 of the rotary mover 40 is slidably installed in the horizontal long hole 51 in a penetrating manner. Since the shaft member 49 is slidably inserted into the horizontal long hole 51, horizontal force, among forces transmitted from the rotary mover 40 to the transmission lever 50, generates sliding and a vertical force is transmitted as is to cause the transmission lever 50 to move in a vertical direction.

A guide hole 52 is formed in a central portion of the transmission lever 50 in a length direction. Although not shown, a support guide formed in a portion of the frame 10 may be inserted into the guide hole 52 to guide a vertical movement of the transmission lever 50.

A fixing recess 53 allowing the movable contactor 70 and the elastic member 58 to be inserted thereinto may be formed above the transmission lever 50. A pressurization protrusion 54 receiving downward pressure may be formed on an upper end of the transmission lever 50.

The support member 55 is provided below the fixing recess 53 of the transmission lever 50. The support member 55 may be provided as a plate body. One side of the support member 55 may be firmly fixed to a lower portion of the fixing recess 53 through adhesion or screw coupling. The support member 55 may be formed of a material having sufficient rigidity to support pressure of a contact portion.

A lower protrusion portion 56 for fixing a lower end of the elastic member 58 may be formed on an upper portion of the support member 55.

Figure 4:
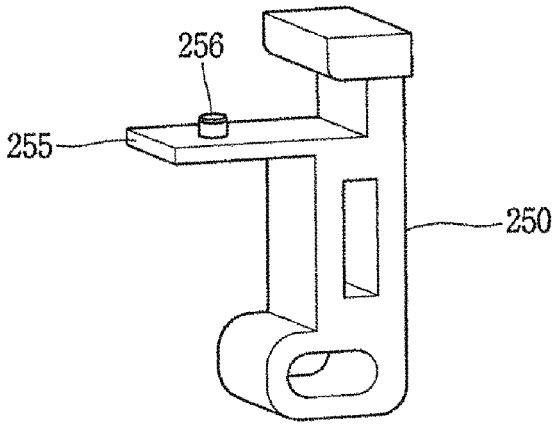
FIG. 4 is a perspective view of a transmission lever applied to a latch relay according to another embodiment of the present disclosure.

Another example of a support member and a transmission lever are illustrated in FIG. 4. Referring to FIG. 4, a support member 255 may be integrally formed with a transmission lever 250. The support member 255 may be formed as a cantilever beam protruding from one side of the transmission lever 250. A lower protrusion portion 256 for fixing a lower end of the elastic member 58 may be formed above the support member 255.

The first fixed contactor 60 is installed on an installation portion 12 formed in an upper portion of the frame 10. One end portion of the first fixed contactor 60 is exposed from a right side of the frame 10 and a first terminal unit 61 connected to a main circuit is provided on the one end portion of the first fixed contactor 60. A fixed contact 62 is coupled to the other end portion of the first fixed contactor 60. The fixed contact 62 may be provided in plurality.

The second fixed contactor 65 is installed in the first fixing part 11. One end of the second fixed contactor 65 is exposed from a right side of the frame 10, and a second terminal unit 66 connected to the main circuit is provided on the one end portion of the second fixed contactor 65. The other end portion 67 of the second fixed contactor 65 is upwardly bent. A lever hole (not shown) allowing the transmission lever 50 to penetrate therethrough to operate may be formed in a central portion of the second fixed contactor 65.

The movable contactor 70 may be formed as a flat plate. The movable contactor 70 may be configured by overlapping a plurality of plates. A movable contact 72 which can be brought into contact with the fixed contact 62 or separated therefrom may be coupled to the movable contactor 70. The movable contact 72 may be formed in plurality.

An upper protrusion portion 71 for fixing an upper end of the elastic member 58 may be formed below the movable contactor 70.

The elastic member 58 is provided between the support member 55 and the movable contactor 70. The elastic member 58 pushes up the movable contactor 70 upon receiving pressure from the support member 55, enabling the movable contact 72 to be brought into contact with the fixed contact 62. An upper end of the elastic member 58 is fixed to the upper protrusion portion 71 of the movable contactor 70 and a lower end thereof is fixed to the lower protrusion portion 56 of the support member 55, whereby the elastic member 58 may be stably maintained to be coupled without being released.

Here, the elastic member 58 may be configured as a compressive coil spring. Since the elastic member 58 is configured as a coil spring, predetermined operation performance may be maintained during ON/OFF operations, durability may be increased, and variations of products in terms of deformation may be reduced.

Meanwhile, the movable contactor 72 provided in the movable contactor 70 and the fixed contact 62 provided in the first fixed contactor 60 may be disposed to be aligned with the elastic member 58 in centers thereof. Thus, a contact force transmitted to a contact portion through the elastic member 58 may effectively work. In particular, preferably, the movable contact 72, the fixed contact 62, and the elastic member 58 are installed to be close to the transmission lever 50 to minimize a movement required when the transmission lever 50 makes a vertical movement. Thus, a magnitude of a required movement is reduced and a rotational phenomenon of the transmission lever 50 may be reduced.

An operation of the latch relay according to an embodiment of the present disclosure will be described with reference to FIGS. 5A and 5B.

Figure 5A:
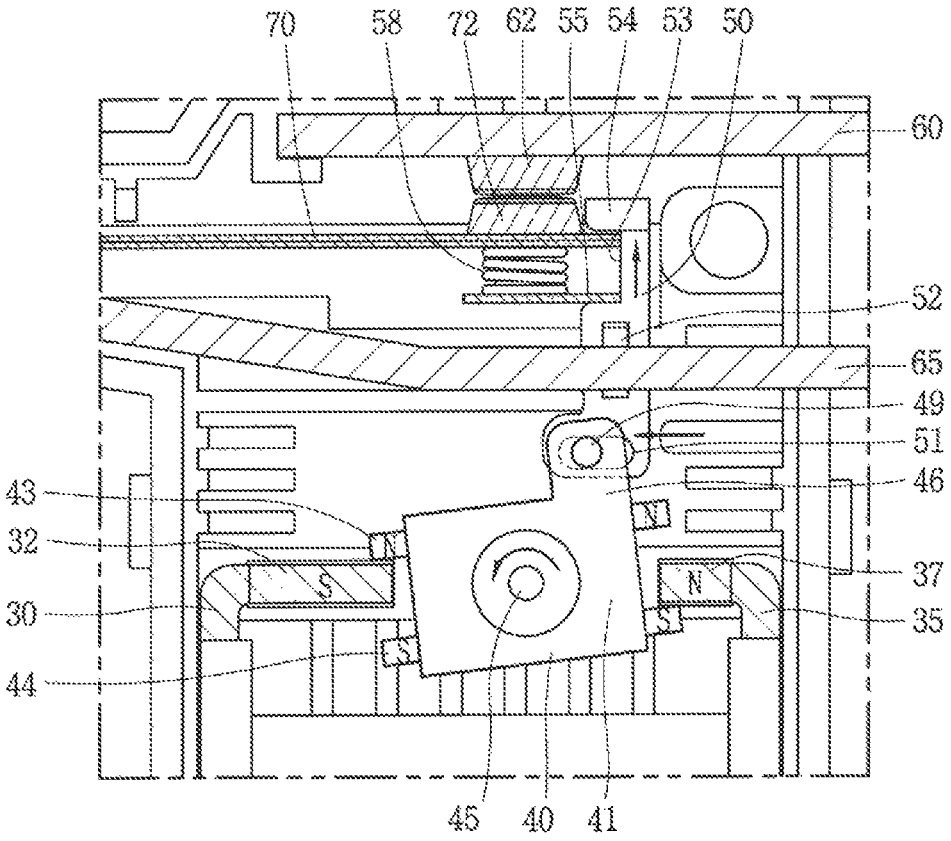

When a current flows in the coil 21 in one direction by an external power connected to the terminal block 80 (or when a switch is turned on), as illustrated in FIG. 5A, the first yoke 30 is magnetized to an S pole and the second yoke 35 is magnetized to an N pole (here, the polarities may be formed in a reverse manner according to a direction of a current or characteristics of a coil). Accordingly, the rotary mover 40 in which the first magnet plate has an N pole and the second magnet plate 44 has an S pole rotates about the rotational shaft 45 in a counterclockwise direction. Accordingly, the shaft member 49 makes a rotational movement centered on the rotational shaft 45 in the counterclockwise direction. Among rotational movements of the shaft member 49, a horizontal movement force is changed into a sliding movement within the horizontal long hole 51 of the transmission lever 50, and a vertical movement force causes the transmission lever 50 to move upwardly. As the transmission lever 50 is lifted, the elastic member 58 is pushed up to push up the movable contactor 70 and the movable contact 72 to cause the movable contact 72 to be brought into contact with the fixed contact 62. Accordingly, the first terminal unit 61 and the second terminal unit 66 of the main circuit are connected to allow a current to flow.

Figure 5B:
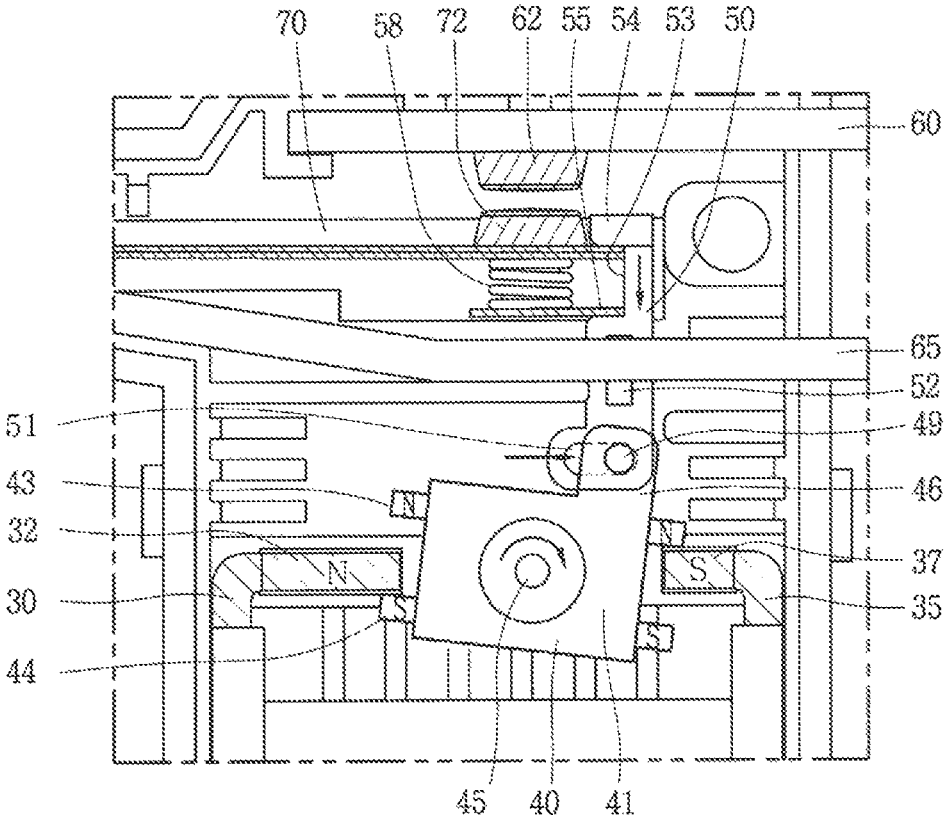

Conversely, when a current flows in the coil 21 in a direction opposite to the direction mentioned above by the external power source connected to the terminal block 80 (or when the switch is turned off), as illustrated in FIG. 5B, the first yoke 30 is magnetized to an N pole and the second yoke 35 is magnetized to an S pole. Accordingly, the rotary mover 40 rotates about the rotational shaft 45 in a clockwise direction. Thus, the shaft member 49 makes a rotational movement in the clockwise direction, centered on the rotational shaft 45. Among rotational movements of the shaft member 49, a horizontal movement force is changed into a sliding movement within the horizontal long hole 51 of the transmission lever 50 and a vertical movement force causes the transmission lever 50 to move downwardly. As the transmission lever 50 is lowered, the movable contactor 70 and the elastic member 58 are pushed down and the movable contact 72 is separated from the fixed contact 62. Accordingly, the first terminal unit 61 and the second terminal unit 66 of the main circuit are disconnected to cut off a flow of current.

As described above, in the latch relay according to an embodiment of the present disclosure, since the support member and the elastic member are provided between the movable contactor and the transmission lever so the movable contact may be brought into contact with the fixed contact or separated therefrom in a straight line, while receiving a vertical force, stable conduction and breaking performance may be exhibited.

In addition, since the elastic member is configured as a coil spring, predetermined operation performance is maintained when the latch relay is turned on or off, durability may be increased, and variations of products in terms of deformation may be reduced.

The foregoing embodiments and advantages are merely exemplary and are not to be considered as limiting the present disclosure. The present teachings can be readily applied to other types of apparatuses. This description is intended to be illustrative, and not to limit the scope of the claims. Many alternatives, modifications, and variations will be apparent to those skilled in the art. The features, structures, methods, and other characteristics of the exemplary embodiments described herein may be combined in various ways to obtain additional and/or alternative exemplary embodiments.

As the present features may be embodied in several forms without departing from the characteristics thereof, it should also be understood that the above-described embodiments are not limited by any of the details of the foregoing description, unless otherwise specified, but rather should be considered broadly within its scope as defined in the appended claims, and therefore all changes and modifications that fall within the metes and bounds of the claims, or equivalents of such metes and bounds are therefore intended to be embraced by the appended claims.

What is claimed is:

1. A latch relay comprising:

a frame;

a bobbin installed in the frame;

a coil wound around the bobbin;

first and second yokes provided as magnetic bodies each coupled to a side of the bobbin;

a rotary mover formed of a magnetic body and rotating in a clockwise or counterclockwise direction between head portions of the first and second yokes;

a first fixed contactor and a second fixed contactor installed within the frame, the first and second fixed contactors parallel to and spaced apart from one another;

a movable contactor having one end connected to the second fixed contactor;

a transmission lever having one end connected to one side of the rotary mover such that the transmission lever moves vertically;

a support member parallel to the movable contactor and fixed to one side of the transmission lever; and an elastic member between the support member and the movable contactor and providing contact force such that the movable contactor moves according to movement of the transmission lever and either contacts the first fixed contactor or separates from the first fixed contactor.

2. The latch relay of claim 1, wherein the elastic member is configured as a compressive coil spring.

3. The latch relay of claim 1, wherein the support member is integrally formed with the transmission lever.

4. The latch relay of claim 1, further comprising a movable contact provided in the movable contactor and a fixed contact provided in the fixed contactor such that centers of the movable contact and the fixed contact are aligned with the elastic member.

5. The latch relay of claim 1, further comprising:

a lower protrusion portion formed on an upper portion of the support member for fixing the elastic member; and an upper protrusion portion formed on a lower portion of the movable contactor for fixing the elastic member.

* * * * *